US005988477A

United States Patent [19]

Deieso et al.

[11] Patent Number: 5,988,477

[45] Date of Patent: Nov. 23, 1999

[54] NOSEPIECE SHIELD FOR COMBUSTION POWERED TOOL

[75] Inventors: Tony Deieso, Wadsworth; Mohamed K. Wagdy, Arlington Heights, both of Ill.

[73] Assignee: Illinois Tools Works, Inc., Glenview, Ill.

[21] Appl. No.: 09/089,902

[22] Filed: Jun. 3, 1998

[51] Int. Cl.[6] ..... B25C 1/04

[52] U.S. Cl. ..... 227/130; 227/10; 227/156

[58] Field of Search ..... 227/130, 10, 11, 227/156, 142, 123, 140, 8

[56] References Cited

U.S. PATENT DOCUMENTS

| | | | |
|---|---|---|---|
| Re. 32,452 | 7/1987 | Nikolich | 123/46 |
| 3,301,456 | 1/1967 | Schafroth et al. | 227/123 |
| 3,572,572 | 3/1971 | Readyhough | 227/130 |
| 3,853,257 | 12/1974 | Perkins | 227/123 |
| 3,991,925 | 11/1976 | Buchel | 227/10 |
| 4,280,248 | 7/1981 | Herubel | 227/130 |
| 4,403,722 | 9/1983 | Nikolich | 227/8 |
| 4,483,473 | 11/1984 | Wagdy | 227/8 |
| 4,483,474 | 11/1984 | Nikolich | 227/8 |
| 4,522,162 | 6/1985 | Nikolich | 123/46.5 |
| 4,611,739 | 9/1986 | Rowton | 227/156 |
| 4,858,811 | 8/1989 | Brosius et al. | 227/10 |
| 5,110,030 | 5/1992 | Tanji | 227/130 |
| 5,170,922 | 12/1992 | Ehmig et al. | 227/8 |
| 5,197,646 | 3/1993 | Nikolich | 227/8 |
| 5,263,439 | 11/1993 | Doherty et al. | 123/46 |
| 5,263,842 | 11/1993 | Fealey | 227/130 |
| 5,558,264 | 9/1996 | Weinstein | 227/10 |
| 5,687,899 | 11/1997 | Dohi et al. | 227/10 |

OTHER PUBLICATIONS

Title: Paslode Tool Schematic and Parts—Model 3175 RCU—Roofing Coil Nailer Author: Paslode Date: Mar. 1998 4 pages.

Title: Paslode New Generation Operating & Maintenance Manual Author: Paslode Date: Apr. 1998 pp. 16 English—16 Spanish.

*Primary Examiner*—Peter Vo
*Assistant Examiner*—James P Calve
*Attorney, Agent, or Firm*—Greer, Burns & Crain, Ltd.; Mark W. Croll

[57] ABSTRACT

A combustion powered tool for driving fasteners including a housing with a main chamber. Within the main chamber is a power source having a combustion end and a lower end. The combustion end of the power source drives a rod. Fasteners are sequentially fed to the rod for driving engagement with the rod. Depending from the lower end of the power source is a nosepiece having a tool end, and a workpiece end opposite the tool end. The nosepiece is configured for receiving the rod and for guiding the rod to a workpiece. To protect the nosepiece, a protective shield envelops the nosepiece.

9 Claims, 3 Drawing Sheets

NOSEPIECE SHIELD FOR COMBUSTION POWERED TOOL

BACKGROUND OF THE INVENTION

The present invention relates generally to portable combustion powered fastener driving tools, and specifically to a shield to protect a workpiece-contacting element of a nosepiece of such tools.

Portable combustion powered tools utilized for driving fasteners into workpieces are described in commonly assigned patents to Nikolich U.S. Pat. Re. No. 32,452, and U.S. Pat. Nos. 4,522,162; 4,483,473; 4,483,474; 4,403,722, 5,197,646, 5,263,439, 5,558,264, and 5,687,899, all of which are incorporated by reference herein. Similar combustion powered nail and staple driving tools are available commercially from ITW-Paslode of Vernon Hills, Ill. under the IMPULSE® brand.

Such tools incorporate a generally pistol-shaped tool housing enclosing a small internal combustion engine. The engine is powered by a canister of pressurized fuel gas, also called a fuel cell. A battery-powered electronic power distribution unit produces the spark for ignition, and a fan located in the combustion chamber provides for both an efficient combustion within the chamber, and facilitates scavenging, including the exhaust of combustion by-products. The engine includes a reciprocating piston with an elongated, rigid driver rod disposed within a cylinder body.

A valve sleeve is axially reciprocal about the cylinder and, through a linkage, moves to close the combustion chamber when a work contact element at the end of the linkage is pressed against a workpiece. This pressing action also triggers a fuel metering valve to introduce a specified volume of fuel into the closed combustion chamber.

Upon the pulling of a trigger switch, which causes the ignition of a charge of gas in the combustion chamber of the engine, the piston and driver rod are shot downward to impact a positioned fastener and drive it into the workpiece. The piston then returns to its original, or "ready" position, through differential gas pressures within the cylinder. Fasteners are fed magazine-style into the nosepiece, where they are held in a properly positioned orientation for receiving the impact of the driver rod. Upon ignition of the combustible fuel/air mixture, the combustion in the chamber causes the acceleration of the piston/driver rod assembly and the penetration of the fastener into the workpiece if the fastener is present.

The nosepiece of the tool includes a pair of upper and lower guide members for guiding the driver rod towards the uppermost nail of a nail strip. Fasteners are guided to the workpiece by a workpiece end of the nosepiece.

A disadvantage of conventional combustion powered tools of this type is that the nosepiece is not enclosed by the housing. Therefore, in some applications, damage can occur to the nosepiece if, for example, a workman dropped the tool. Also, the nosepiece is adjustable to vary the depth that the fastener is driven into the workpiece. These adjustments are typically made by the operator of the tool. Thus, there is a need to protect the nosepiece, and the corresponding components of the nosepiece, from external forces. There is also a need to protect the depth adjustment from inadvertent impact or interference by the operator or others.

As a consequence, it is an object of this invention to provide an improved portable combustion powered fastener driving tool with a shield to protect the nosepiece of the tool from impact.

It is a further object of the present invention to provide an improved portable combustion powered fastener driving tool with a nosepiece shield containing access openings for access to the nosepiece depth adjustment.

BRIEF SUMMARY OF THE INVENTION

The above-listed objects are met or exceeded by the present combustion powered tool for driving fasteners featuring a shield which is fixed to the tool housing and is configured to encompass the nosepiece without impairing its operation. Access openings are provided in the shield to provide access to the fastener driving depth adjustment mechanism.

More specifically, the present invention provides a combustion powered tool for driving fasteners having a housing to house a main chamber. Within the main chamber is a power source having a combustion end and a lower end. The combustion end of the power source drives a rod. Fasteners are sequentially fed to the rod for engagement with the rod. Depending from the lower end of the power source is a nosepiece having a tool end, and a workpiece end opposite the tool end. The nosepiece is configured for receiving the rod and for guiding the rod toward a workpiece. To protect the nosepiece, a protective shield envelops the nosepiece.

DETAILED DESCRIPTION OF THE INVENTION

Figure 1:
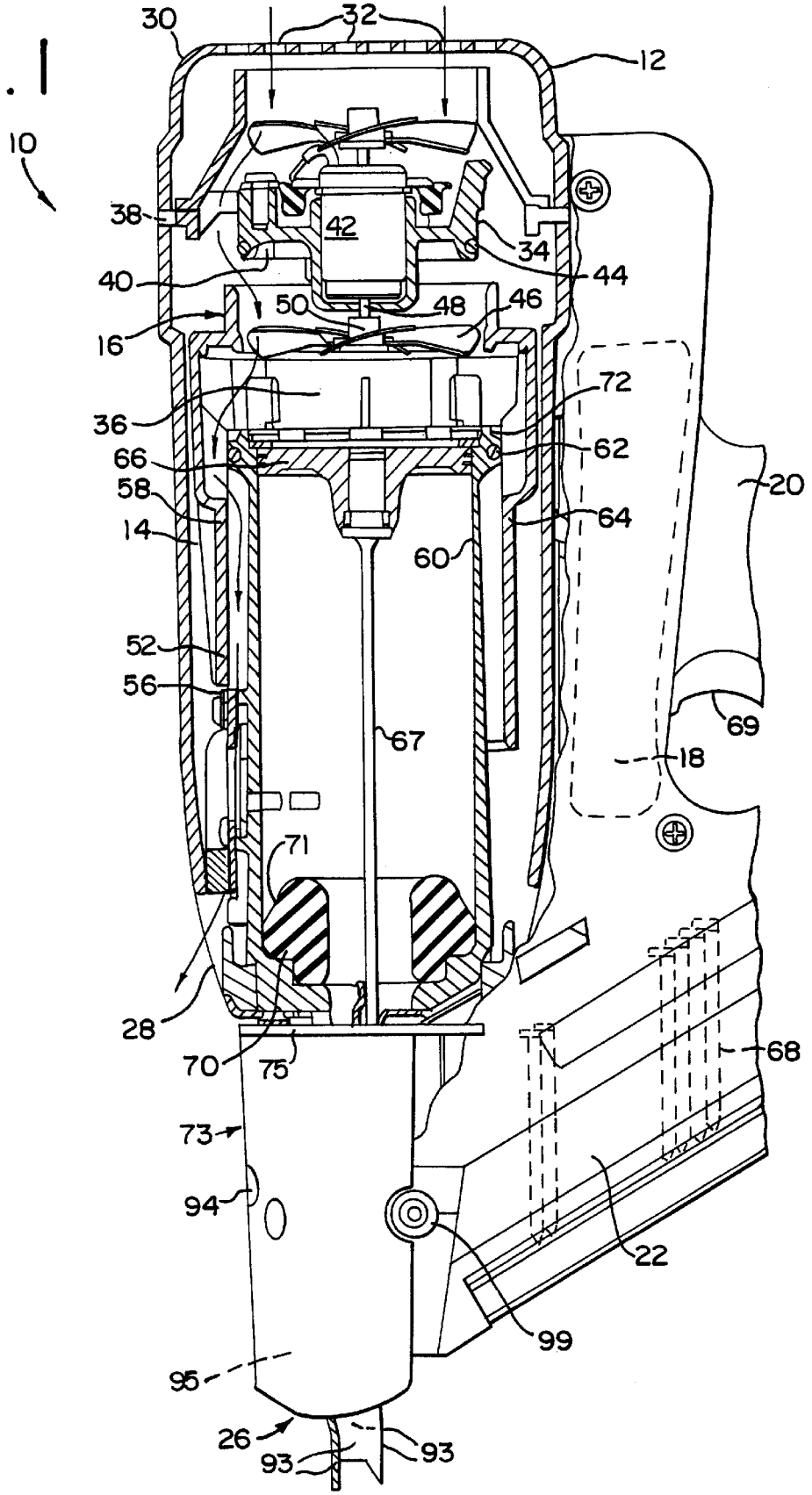
FIG. 1 is a fragmentary side view of a combustion powered fastener tool with the present nosepiece shield, partially cut away for purposes of clarity.
Figure 2:
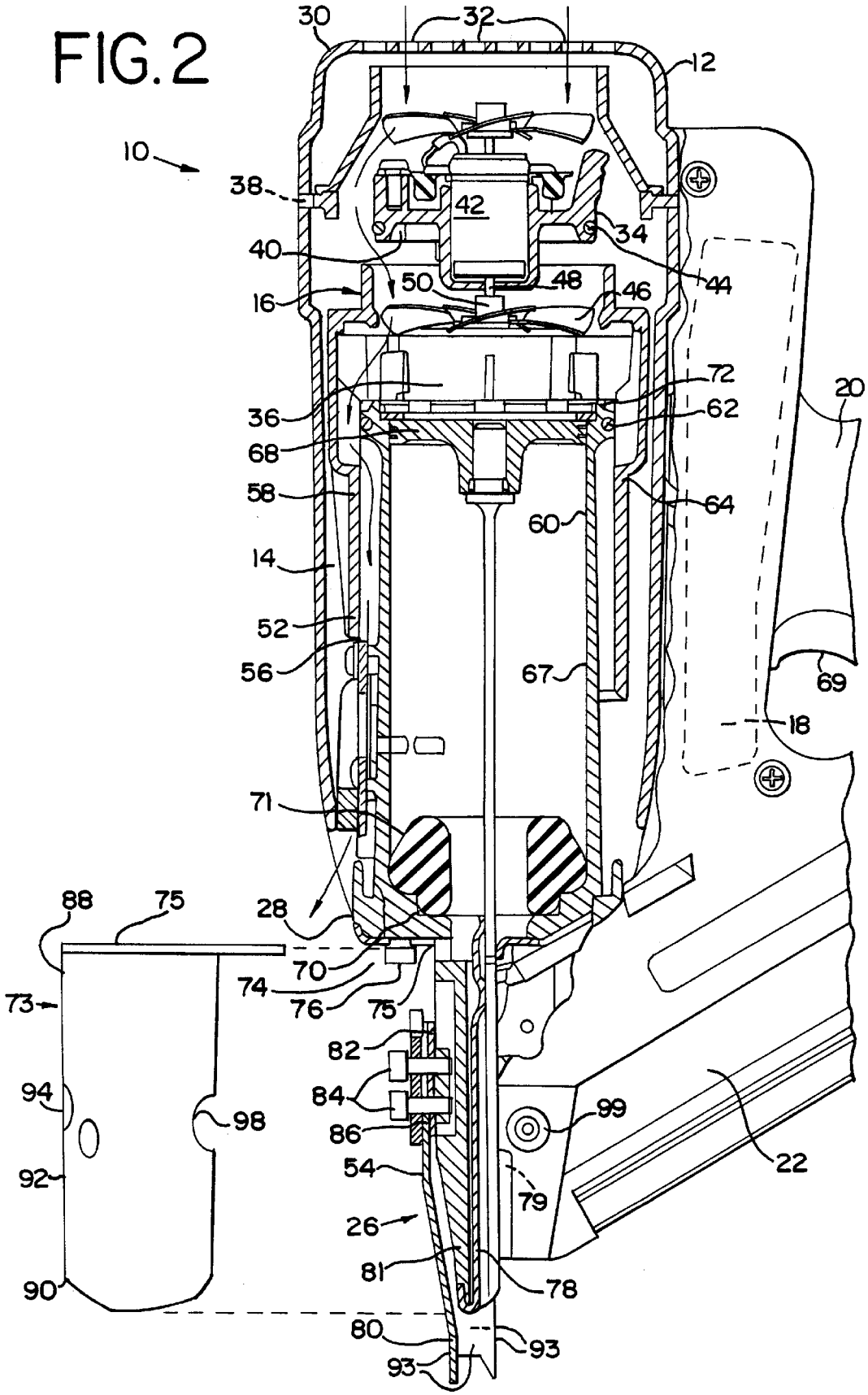
FIG. 2 is a fragmentary side view of a combustion powered fastener tool, partially cut away for purposes of clarity, with an exploded view of the present nosepiece shield.

Referring now to FIGS. 1 and 2, a combustion-powered tool of the type suitable for use with the present invention is generally designated 10. The tool 10 has a housing 12 including a main power source chamber 14 dimensioned to enclose a self-contained internal combustion power source 16, a fuel cell chamber 18 (shown in phantom) generally parallel with and adjacent the main chamber 14, and a handle portion 20 extending from one side of the fuel cell chamber and opposite the main chamber.

In addition, a fastener magazine 22 is positioned below the handle portion and extends to a nosepiece 26 depending from a lower end 28 of the main chamber 14. Preferably the magazine 22 accommodates a strip of nails, as shown, but alternatively may accommodate a coil of nails as shown in U.S. Pat. No. 5,558,264. A battery (not shown) is provided for providing electrical power to the tool 10, and is releasably housed in a tubular compartment (not shown) located in the handle portion 20.

As used herein, "lower" and "upper" are used to refer to the tool 10 in its operational orientation as depicted in FIGS.

1 and 2, and "front" is used to refer to the left side of the tool 10 as depicted in FIGS. 1 and 2; however it will be understood that this invention may be used in a variety of orientations depending on the application. Opposite the lower end 28 of the main chamber is a combustion end 30, which is provided with a plurality of air intake vents 32.

A pressurized liquid hydrocarbon fuel, such as MAPP, is contained within a fuel cell (not shown) and pressurized by a propellant as is known in the art. A fluid communication is established between the fuel cell and the valve. In a preferred embodiment, a mechanically operated valve is used, such as that currently available in an IMPULSE® tool sold by ITW-Paslode. In other embodiments, an electromagnetic solenoid-type fuel metering valve may be used.

Returning to the main chamber 14, a cylinder head 34 is disposed at the combustion end 30 of the main chamber, and defines an upper end of a combustion chamber 36, also located at the upper end of the chamber, and provides a mounting point for a head switch 38 (shown in phantom), a spark plug 40, an electric fan motor 42, and a sealing O-ring 44.

A main or combustion chamber fan 46 is attached to an armature or power shaft 48 of the motor 42 at a first end 50 of the armature. Located within the combustion chamber 36 to axially rotate, the fan 46 thus enhances the combustion process by mixing the fuel and air, and also facilitates cooling and scavenging. The fan motor 42 is controlled by the head switch 38, as disclosed in more detail in the prior patents incorporated by reference. The fan 46 serves as a main air flow enhancing device for enhancing the flow of air within the combustion chamber 36.

A generally cylindrical, reciprocating valve member or valve sleeve 52 is moved within the main chamber 14 by a workpiece-contacting element 54 slidably mounted on an outside of the nosepiece 26 using a linkage 56. Sidewalls of the combustion chamber 36 are defined by the valve member 52, the upper end of which sealingly engages the O-ring 44 to seal the upper end of the combustion chamber. A lower portion 58 of the valve member 52 circumscribes a generally cylindrical cylinder body 60. An upper end of the cylinder body 60 is provided with an exterior O-ring 62 which engages a corresponding portion 64 of the valve member 52 to seal a lower end of the combustion chamber 36.

Within the cylinder body 60 is reciprocally disposed a piston 66 to which is attached a rigid, elongated driver rod 67 used to drive fasteners 68 (shown hidden in FIG. 1), transported from the magazine 22 and suitably positioned in the nosepiece 26, into a workpiece. As a trigger 69 is pulled, a signal is generated from the central electrical distribution and control unit (not shown) to cause a discharge at a spark gap of a spark plug (not shown), which ignites fuel which has been injected into the combustion chamber 36 and vaporized or fragmented by the fan 46. In response, the piston 66 is driven toward a lower end of the cylinder 60. As the piston 66 approaches the lower end, the driver rod 67 will be guided into the nosepiece 26 and impact a fastener 68 held above a workpiece by the nosepiece. Impact of the driver rod 67 drives the fastener into a workpiece or substrate.

To regulate the use of fuel, the firing of the tool 10 will not occur unless the nosepiece 26 is pressed against a workpiece. Such placement causes the linkage 56 to be pushed upward, which moves the valve member 52 to seal the combustion chamber 36, and also moves linkages (not shown) which operate the mechanical fuel valve. Details concerning sealing of the combustion chamber 36, and related mechanisms may be found in the previously mentioned Nikolich patents, which are incorporated by reference.

A lower end of the cylinder body 60 defines a seat 70 for a bumper 71 which defines the lower limit of travel of the piston 66. At the opposite end of the cylinder body 60, a piston stop ring 72 is affixed to limit the upward travel of the piston 66.

Referring now to FIG. 2, a shield 73 of a preferred embodiment of the present invention protects the nosepiece 26 with its corresponding components. At a tool end 74 of the nosepiece 26 is a retaining ring 75 fixed to the lower end 28 of the power source 16 by at least one screw 76 or other threaded fastener. The nosepiece 26 further includes a pair of front and rear guide members 78 and 79 disposed below the retaining ring 75. In a preferred embodiment, the rear guide member 79 is actually a front surface of the magazine 22. Mating surfaces (not shown) of the front and rear guide members 78 and 79 are formed with semi-circular grooves. Upon assembly of the nosepiece 26, the semi-circular grooves of the mating surfaces form a guide passage (not shown) having a ID cross sectional shape corresponding to the shape of, and coaxial with, the driving rod 67 and fasteners 68 for guiding the driving rod and the fasteners.

Through the guide passage, the fasteners 68 are guided to the workpiece, which is located at the workpiece end 80 of the nosepiece 26. A rear end portion of the semi-circular groove of the rear guide member 79 is tapered to form a notch (not shown) for receiving the fastener 68 from the magazine 22. The nosepiece 26 also includes the workpiece-contacting element 54 which extends generally vertically in spaced, generally parallel relationship to a front surface 81 of the front guide member 78. A lower portion 82 of the linkage 56 is fixed to the workpiece-contacting element 54 by at least one and preferably two depth of drive adjustment screws 84. The screws 84 pass through a vertically extending slot 86 in the workpiece contacting element 54. By temporarily loosening the screws 84, the relative vertical position of the element 54 and the linkage portion 82 may be adjusted as is known in the art. Further details of the nosepiece arrangement may be found in U.S. Pat. No. 5,687,899 which was incorporated above by reference.

Figure 3:
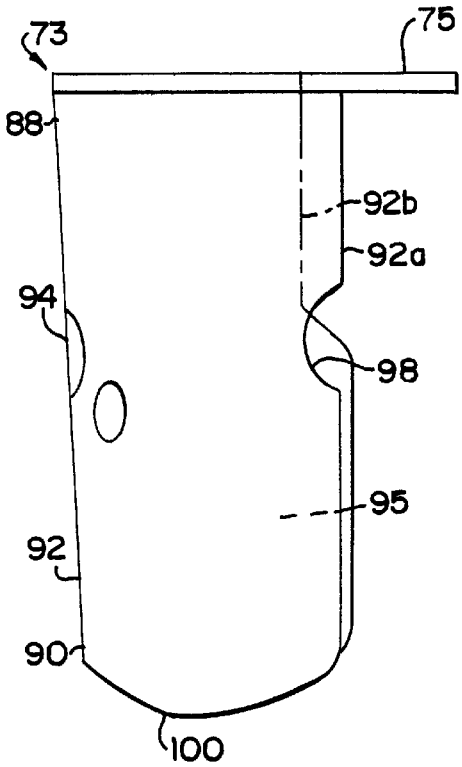
FIG. 3 is an isolated side view of the present nosepiece shield.
Figure 4:
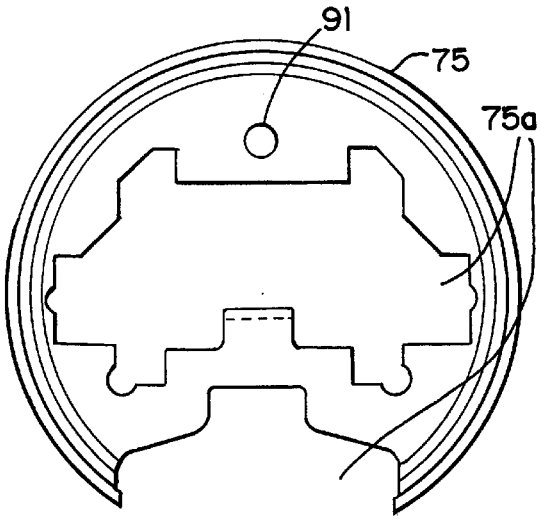
FIG. 4 is an isolated top view of the present nosepiece shield showing the retaining ring.

Referring now to FIGS. 3 and 4, the shield 73 has a top end 88, a bottom end 90, and a generally tubular shape configured to circumscribe the nosepiece 26. The shield 73 is preferably of durable construction, and can be manufactured, for example, from 16-gauge 1050 cold rolled steel. The use of other equivalent engineered materials or metals is also contemplated. The retaining ring 75 is fastened to the top end 88 of the shield 73, and is configured for attachment to the lower end 28 of the power source 16. In length, the shield 73 is configured so that when the nosepiece 26 is pushed against the workpiece, and the workpiece contacting element 54 is completely retracted, the bottom end 90 of the shield 73 occupies a position substantially flush with the workpiece. A longitudinal peripheral wall 92 of the shield 73 is inclined from the top end 88 to the bottom end 90 to form a generally hollow inverted conical shape. This shape accommodates the nosepiece 26, the movement of the workpiece-contacting element 54, the linkage portion 82, and the screws 84, yet provides good visibility of the workpiece.

More specifically, the retaining ring 75, which is a previously existing component of the tool 10, has a generally circular shape with notches 75*a* defined therein to accommodate parts of the nosepiece 26, and the driver rod 67. Additionally, the retaining ring 75 contains a hole 91 for accepting the screw 76 to attach the retaining ring 75 to the lower end 28 of the power source 16. To fasten the shield 73 to the retaining ring 75, the shield 73 is preferably welded along the top end 88 to at least 75% of a perimeter of the retaining ring 75. Alternatively, the shield 73 could be stamped or molded in one piece, or molded into a die cast housing which could be part of the main body.

To protect the four sides 93 of the nosepiece 26 (best seen in FIG. 2), the shield 73 is constructed and arranged to cover at least three of the sides, the fourth side being abuttingly engaged by the fastener magazine 22. Rearward facing edges 92*a*, 92*b* of the wall 92 define a space for accommodating the magazine 22.

Figure 5:
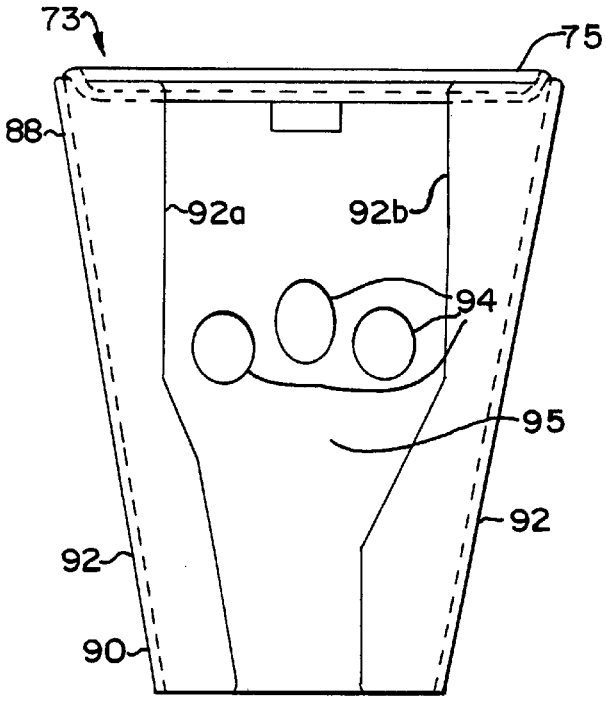
FIG. 5 is an isolated back view of the present nosepiece shield.

As shown in FIG. 5, at least one access opening 94 (preferably three are provided) in the shield 73 is provided for access to the drive adjustment screws 84 on the nosepiece 26. Each access opening 94 is constructed and arranged so that only one of the drive adjustment screws 84 can be accessed at a time. For example, one of the screws 84 can be accessed while the nosepiece 26 is in an unretracted position, and the other can be accessed when the nosepiece 26 is retracted, as occurs when the tool is pressed against the workpiece. Multiple access openings 94 are provided to allow the same nosepiece shield 73 to be used on a variety of tools 10. Furthermore, the shield 73 is constructed to define a cavity 95 between the nosepiece 26 and the shield 73 to allow the drive adjustment.

Figure 6:
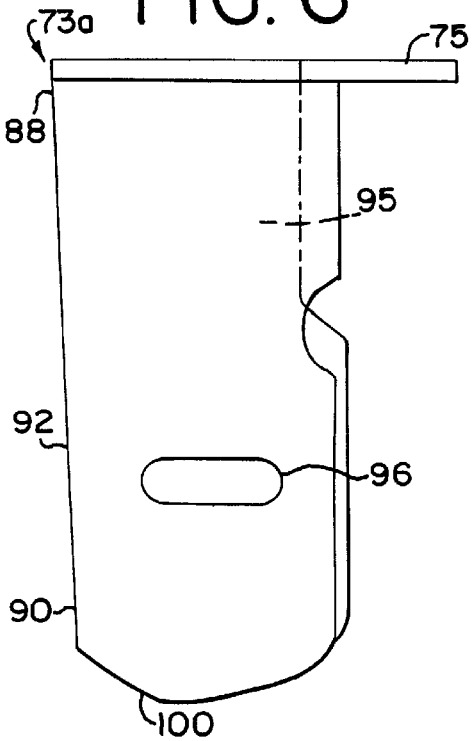
FIG. 6 is an isolated view of an alternative embodiment of the present nosepiece shield.

FIG. 6 shows an alternative embodiment of the present shield which is generally designated 73*a*. Shared components between the shields 73 and 73*a* are indicated with the identical reference numerals. The shield 73*a* is designed for use on a smaller combustion type tool used for driving fasteners 68 into more delicate workpieces such as in trim work. An opening 96 is provided in the shield 73*a* for access to a depth adjustment of the nosepiece 26. A notch 98 in the shield 73*a* allows access to a screw 99 (shown in FIG. 1) for the fastener magazine 22. As is the case with the shield 73, the shield 73*a* has a generally curved lower edge 100 which allows the tool to be angled relative to the workpiece for application when the fastener 68 needs to be driven on an angle. It is contemplated that other such openings and notches 94, 96, 98, may be added when necessary to fit combustion powered tools of various configurations.

While a particular embodiment of the shield for the nosepiece of a combustion-powered tool of the invention has been shown and described, it will be appreciated by those skilled in the art that changes and modifications may be made thereto without departing from the invention in its broader aspects and as set forth in the following claims.

We claim:

1. A combustion powered tool, comprising:

a housing having a main chamber;

a power source having a combustion end and a lower end enclosed in said main chamber;

a rod driven by said combustion end of said power source;

means for feeding fasteners sequentially for engagement with said rod;

a nosepiece having a tool end, a workpiece end opposite said tool end, said workpiece end including a workpiece-contacting element and depending from said lower end of said power source, said nosepiece configured for receiving said rod from said lower end of said power source and for guiding said rod toward a workpiece;

said workpiece-contacting element being slidably mounted on said nosepiece, said workpiece-contacting element configured to retract upon the tool being pressed against a workpiece;

protecting means for protecting said nosepiece and said workpiece-contacting element, said protecting means being in contact with the workpiece when said tool is pressed onto the workpiece and the workpiece contacting element is retracted;

said nosepiece has four sides, said protecting means being constructed and arranged to cover at least three of said sides of said nosepiece, and to define a cavity between said nosepiece and said protecting means, said protecting means being tapered from an upper end to a lower end in a generally inverted conical shape to facilitate visibility of the workpiece upon placement of said tool thereon and retraction of said workpiece contacting element.

2. The tool as defined in claim 1 wherein said fastener feeding means is a magazine.

3. The tool as defined in claim 1 wherein said generally inverted conical shape of said protecting means is configured to circumscribe said nosepiece.

4. The tool as defined in claim 1 wherein said protecting means has a top end and a bottom end, said top end being fastened to said lower end of said power source.

5. The tool as defined in claim 4 further including a retaining ring at said top end configured for attachment to said lower end of said power source.

6. The tool as defined in claim 5 wherein said top end of said protecting means is welded to at least 75% of a perimeter of an underside of said retaining ring.

7. The tool as defined in claim 1 further including at least one access opening in said protecting means for access to at least one depth of drive adjustment on said nosepiece, said at least one depth of drive adjustment including a pair of adjustment screws, and said corresponding access opening is constructed and arranged so that only one of the drive adjustment screws can be accessed at a time.

8. The tool as defined in claim 1 wherein said protecting means has a bottom end, said bottom end being substantially flush with said workpiece end of said nosepiece in a completely retracted position when said tool is pushed against the workpiece.

9. A combustion powered tool, comprising:

a housing having a main chamber;

a power source having a combustion end and a lower end enclosed in said main chamber;

a rod driven by said combustion end of said power source;

means for feeding fasteners sequentially for engagement with said rod;

a nosepiece having a tool end, a workpiece end opposite said tool end, said workpiece contacting end including a workpiece-contacting element and depending from said lower end of said power source, said nosepiece configured for receiving said rod from said lower end of said power source and for guiding said rod toward a workpiece;

said workpiece-contacting element slidably mounted on an outside of said nosepiece;

protecting means for protecting said nosepiece and said workpiece-contacting element;

said nosepiece has four sides, said protecting means being constructed and arranged to cover at least three of said sides of said nosepiece, and to define a cavity between said nosepiece and said protecting means, said protecting means being tapered from an upper end to a lower end in a generally inverted conical shape to facilitate visibility of the workpiece; and said protecting means has a generally curved lower edge which allows said tool to be angled forward and rearward relative to the workpiece for driving fasteners on an angle.

* * * * *